US006832668B2

(12) United States Patent
Henson

(10) Patent No.: US 6,832,668 B2
(45) Date of Patent: Dec. 21, 2004

(54) DESCENDER APPARATUS

(75) Inventor: William E. Henson, Otter Lake, MI (US)

(73) Assignee: American Escape Systems, Inc., Rochester Hills, MI (US)

( * ) Notice: Subject to any disclaimer, the term of this patent is extended or adjusted under 35 U.S.C. 154(b) by 0 days.

(21) Appl. No.: 10/322,864

(22) Filed: Dec. 20, 2002

(65) Prior Publication Data

US 2004/0118636 A1 Jun. 24, 2004

(51) Int. Cl.[7] ..... A62B 1/00
(52) U.S. Cl. ..... 182/236; 182/72
(58) Field of Search ..... 182/70, 73, 75, 182/71, 72, 231–240

(56) References Cited

U.S. PATENT DOCUMENTS

| | | | | | |
|---|---|---|---|---|---|
| 297,126 | A | | 4/1884 | Freeman | |
| 539,958 | A | | 5/1895 | Madden | |
| 734,440 | A | * | 7/1903 | Smith | 182/240 |
| 797,903 | A | * | 8/1905 | Meaders | 182/240 |
| 1,033,311 | A | * | 7/1912 | Gilloon | 182/240 |
| 1,352,230 | A | | 9/1920 | Vescovi | |
| 1,494,467 | A | * | 5/1924 | Edwaards | 182/240 |
| 4,024,927 | A | * | 5/1977 | Sheppard | 182/5 |
| 4,130,176 | A | | 12/1978 | Paulie | |
| 4,171,795 | A | * | 10/1979 | Bianchi | 182/236 |
| 4,580,658 | A | * | 4/1986 | Brda | 182/5 |
| 5,060,758 | A | * | 10/1991 | Ishioka | 182/234 |
| 5,682,962 | A | | 11/1997 | Lo | |

* cited by examiner

*Primary Examiner*—Alvin Chin-Shue
(74) *Attorney, Agent, or Firm*—Alex Rhodes

(57) ABSTRACT

A compact descender apparatus which is easy to use and easy to store for lowering a person from an elevated position to a relatively lower position, having a generally cylindrical housing; a spool mounted for rotation in the housing having an axis of rotation which is in orthogonal relationship to a front face of the housing; a rope stored on the spool having a free end portion which extends upwardly to a helical groove on an outer portion of a friction core which is mounted on an upper portion of said housing for controlling a rate of descent with the descender; and a camshaft rotatably mounted in the housing for adjusting the rate of descent. A tang extending downwardly from a lower portion of the housing and a pair of spaced apart bosses having apertures on an upper portion of said housing are provided for attaching the descender apparatus.

6 Claims, 3 Drawing Sheets

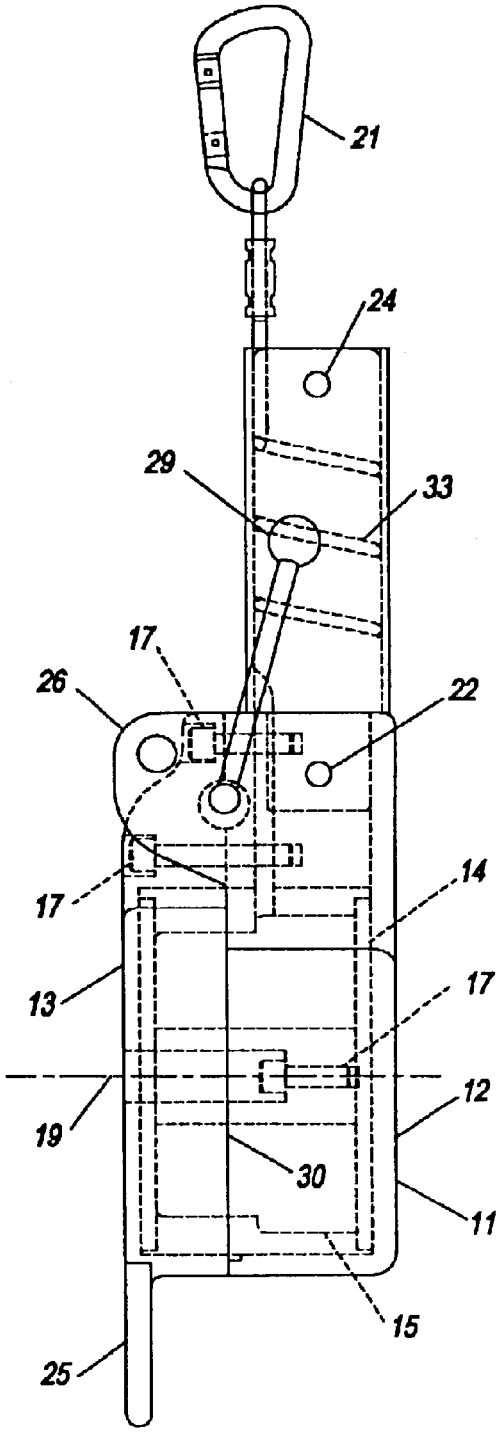
FIG. 4
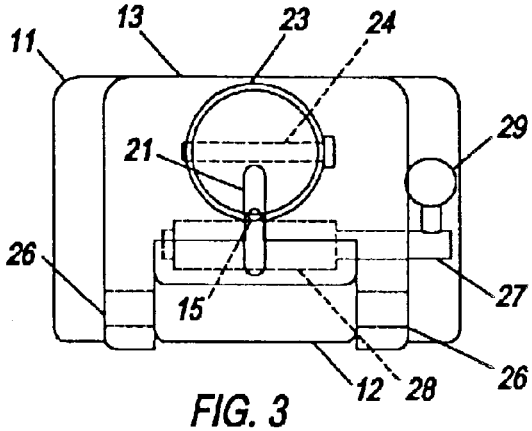
FIG. 3
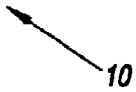

DESCENDER APPARATUS

FIELD OF THE INVENTION

This invention generally relates to escape apparatus and more particularly to an improved descender apparatus for lowering a person from a height to a relatively lower height.

BACKGROUND OF THE INVENTION

Recent trends have identified a need for an easy to use descender for rescuing persons from ships, residences and office buildings during emergencies. One trend is the desire to conserve valuable land by constructing larger, taller and densely populated commercial buildings. Upper floors of new buildings, such as office buildings, hospitals and hotels exceed the rescue capabilities of firemen's equipment, such as nets and ladders. Another trend is the construction of new suburbs in which traditional fire fighting equipment is not readily available. Recent events have shown that traditional fire fighting equipment cannot fully evacuate many buildings during catastrophes, such as terrorist attacks, earthquakes and fires. The recent shift from large armies to small combat units has also identified a need for descenders for deploying troops from low flying helicopters.

There are a number of drawbacks with the descenders which exist in the art. Small descenders, used by professionals, such as firemen, tree trimmers, window washers and mountain climbers are relatively simple but require physical abilities, skill and training. Others are expensive, complex and difficult to use. Still others are difficult to store and are not portable.

SUMMARY OF THE INVENTION

With the foregoing drawbacks in mind, the present invention is a compact descender which is easy to use, easy to store and moderate in cost. One distinguishing feature of the invention is that a rope is stored inside of the descender. Another distinguishing feature is that a novel mounting system is provided for attaching the descender to a harness. Another distinguishing feature is a novel means for adjusting a rate of descent.

One benefit of the invention is that it is portable. This feature is important to professionals and sportsman such as firefighters, window trimmers, window washers and mountain climbers who must carry other equipment such as axes, gas masks, etc.

Another benefit of the invention is that it requires little, if any, training before it is used. Still yet another benefit is that it can be stored in existing spaces, such as desks, file cabinets, closets and bedroom dressers. Still yet another benefit is that it can be quickly placed in service.

The invention broadly comprises a generally cylindrical two part housing; a spool mounted for rotation inside of the housing, a rope stored on the spool; a friction core extending upwardly from an upper portion of the housing; a sleeve in surrounding relationship to the friction core; a means for adjusting a rate of descent and a means on a front part of the housing for attaching the descender to a restraint device, such as a body harness.

In employing the teaching of the present invention, a plurality of alternate constructions can be adopted to achieve the desired results and capabilities. In this disclosure, one embodiment is discussed. However, the disclosed embodiment is intended as an example only and should not be considered as limiting the scope of the invention.

Further features and benefits will be apparent by reference to the drawings and ensuing detailed description of a preferred embodiment which discloses the best mode contemplated in carrying out the invention. The exclusive rights which are claimed are set forth in the numbered claims following the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a preferred embodiment of the invention by way of non-limiting example only.

FIG. 3 is a plan view of the descender apparatus.

FIG. 4 is a front elevation view of the descender apparatus.

DETAILED DESCRIPTION OF A PREFERRED EMBODIMENT

Figure 2:
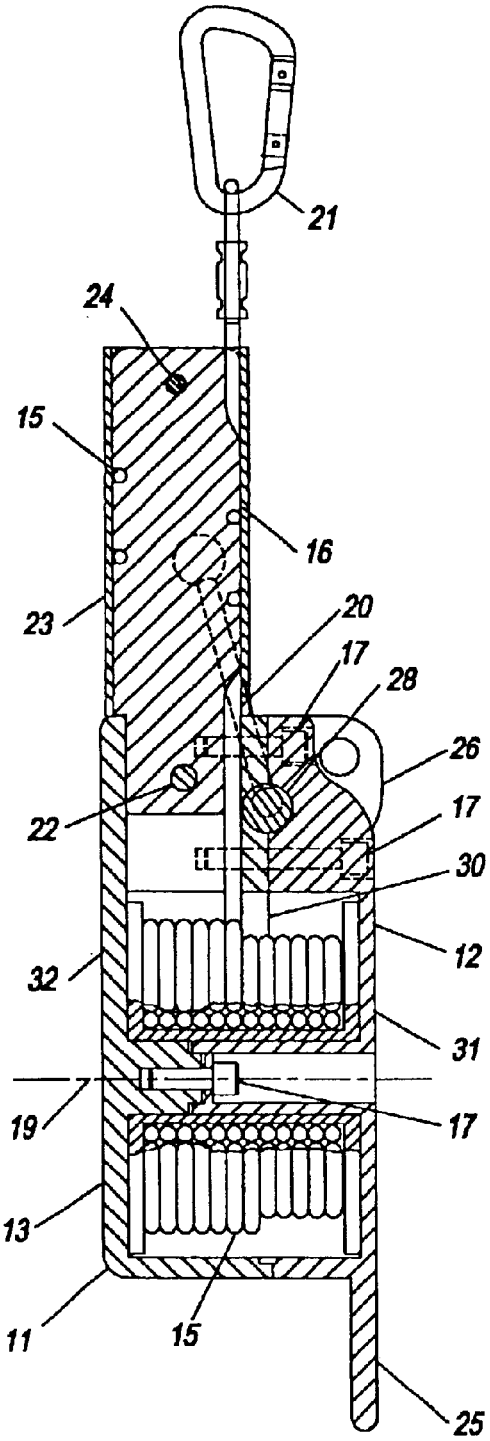
FIG. 2 is a cross-sectional view taken on the line 2—2 in FIG. 1.

Referring now to the drawings wherein like numerals designate like and corresponding parts throughout the several views, a preferred embodiment of a descender apparatus 10 is shown according to the invention. One feature which is readily apparent from the drawings is that the descender 10 is a compact device. As such, it can be easily store in existing spaces and carried by sportsmen, workmen and firefighters who are exposed to high places. Another feature which is apparent is that a safety rope 15 is stored inside of the descender 10.

The descender 10 comprises a generally two part cylindrical housing 11 having a front portion 12 and a rear portion 13, a spool 14 mounted for rotation inside of the housing 11, a rope 15 stored on the spool 14; a friction core 16 extending upwardly from an attachment to an upper portion of the housing 11; a sleeve 23 in surrounding relationship to the friction core 16; a means for adjusting a rate of descent and a means on a front part of the housing 11 for attaching the descender 10 to a restraint device (not shown), such as a body harness.

The front portion 12 of the housing 11 is attached to the rear portion 13 of the housing 11 with five socket head screws 17 which threadably engage the rear portion 13 of the housing 11. With reference to FIG. 2, the spool 14 is mounted for rotation in the housing 11 on a split spool 14 which is formed integrally with the front 12 and rear 13 portions of the housing 11.

With the orientation used in the drawings, the axis 19 of the spool 14 has an orthogonal relationship to front 31 and rear 32 faces of the housing 11. The rope 15 which is stored on the spool 14 has a free end portion 20 which extends upwardly to a helical groove 33 of the friction core 16 which is attached to an upper portion of the housing 11. At the end of the rope 15 there is a carabiner 21 for attaching the rope 15 to a fixed portion, such as a window bar (not shown) of a building.

As depicted in FIG. 3, the rope 15 is withdrawn from the friction core 16 at about a center of the descender 10. This is also a distinguishing feature of the invention. The friction core 16 is attached to the housing 11 with a pin 22 that is pressed into the housing 11. The purpose of the friction core 16 is to provide friction against the rope 15 to slow the rate of descent. The friction core 16 is enclosed with a thin sleeve 23. The sleeve 23 is retained to the friction core 16 with a pressed in pin 24.

One benefit of this arrangement is that a large quantity of rope 15 can be stored in the housing 11. In a prototype descender an eighty foot ⅛ inch diameter rope 15, made of a high strength polymer, was stored on a spool 14. This amount of rope 15 is capable of lowering persons from most buildings. Another benefit is that it is an efficient design with a minimum of parts.

The descender 10 is intended to be attached to a safety belt or a body harness. To facilitate its attachment, a downward extending tang 25 and a pair of spaced apart bosses 26 with apertures 34 are provided on the front portion 12 and rear portion 13, respectively, of the housing 11. The tang 25 and bosses 26 are formed integrally with the front portion 12 and rear portion 13 of the housing 11. In my co-pending application Ser. No. 29/180,573 the descender 10 is shown attached to a body harness.

Figure 1:
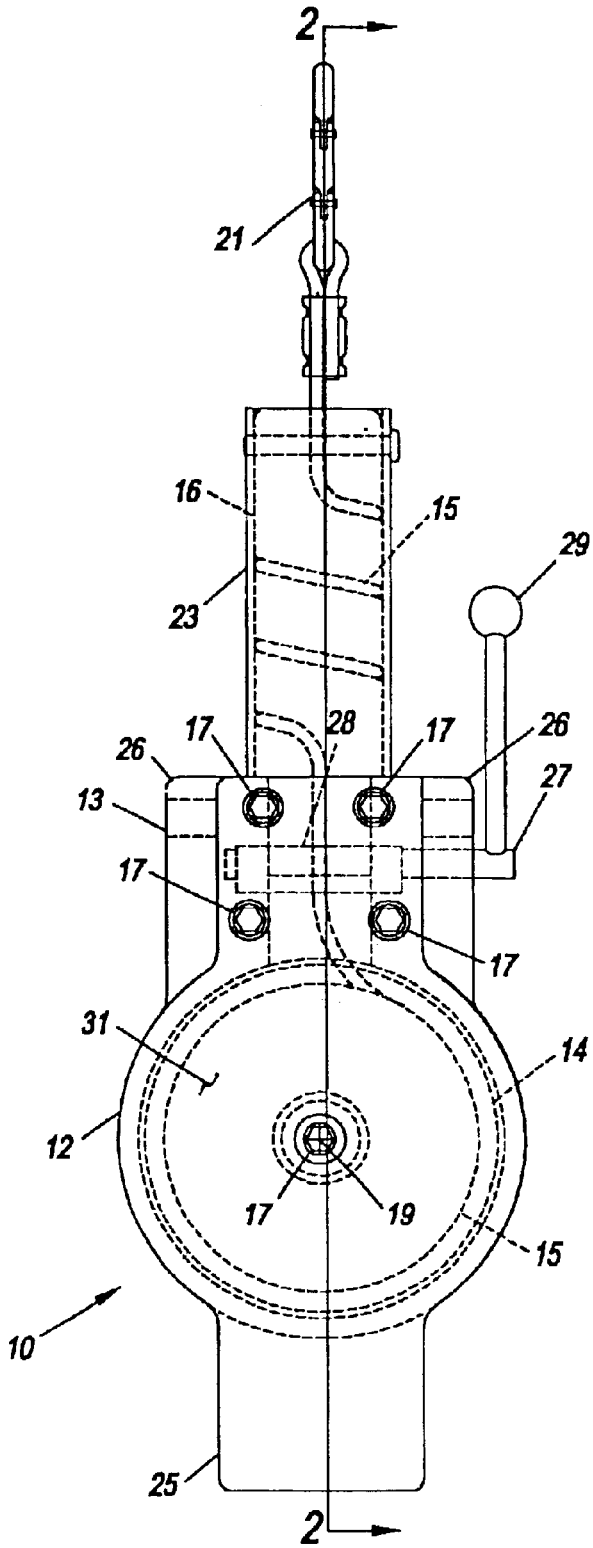
FIG. 1 is a front view of a descender apparatus according to the present invention.
Figures 5, 6:
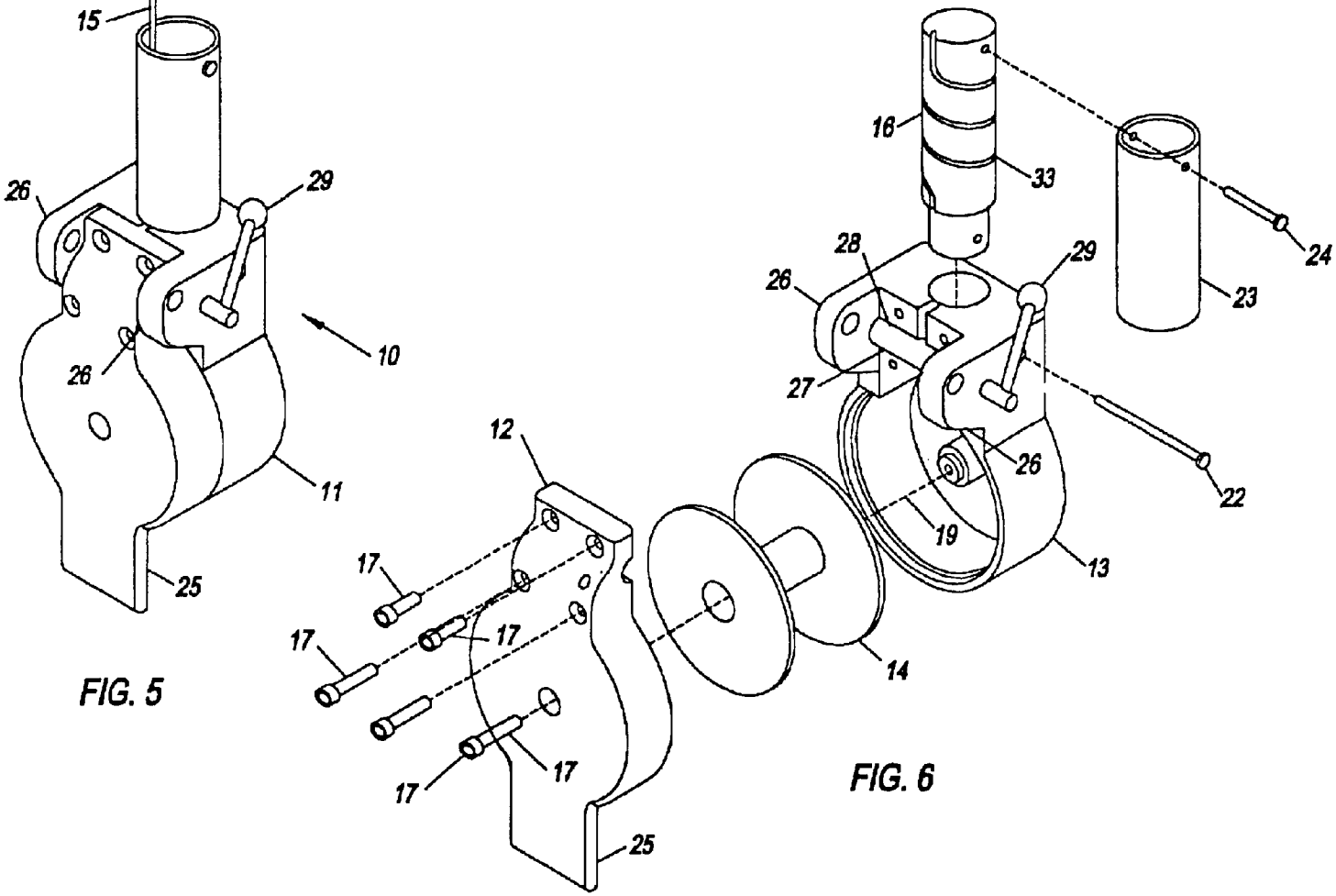
FIG. 5 is a perspective view of the descender apparatus.
FIG. 6 is an exploded view of the descender apparatus.

With reference to FIGS. 1 and 2, the novel means is depicted therein for adjusting the rate of descent. An adjustment of the rate of descent is important to accommodate differences in body weight, which can be significant, and differences in the capacities of persons to tolerate descents from high places. The novel adjusting means consists of a camshaft 27 having a cam portion 28 which presses against a portion of the rope 15 and a handle 29 for rotating the camshaft.

To show the rate of descent, the handle 29 is rotated a small amount in the direction of the front portion 12 of the housing 11. The camshaft 27 is located at the junction of the front 12 and rear 13 portions of the housing 11. This simplifies the installation of the camshaft 27, it being only necessary to place the camshaft 27 between the front 12 and rear 13 portions of the housing 11 before the front portion 12 is attached to the rear 13 portion.

From the foregoing, it will be apparent that my invention is a compact, easy to use, easy to store and moderately priced descender having numerous distinguishing non-obvious features from the prior art.

Although only a single embodiment has been illustrated and described, it will be appreciated that other embodiments can be derived by obvious changes to persons skilled in the art, such as changes in shape, substitution of parts, re-arrangements of parts, inversions of parts and elimination of parts without departing from the scope of the claims which are appended hereto.

What I claim is new is:

1. A descender apparatus for lowering a person from an elevated position to a relatively lower position, comprising: a housing; a means for mounting said descender apparatus on said person; a spool mounted for rotation in said housing, said spool having an axis of rotation which is perpendicular to a path of travel of said descender apparatus; a rope stored on said spool for lowering of said person; a cylindrical friction core extending upwardly from said spool, said friction core having an axis which is perpendicular to said axis of rotation of said spool and a helical groove extending along an outer portion of said friction core for receiving a portion of said lifeline for controlling a rate of descent of said person as said rope is withdrawn from said spool; a sleeve in surrounding relationship to said friction core and said portion of said rope in said helical groove of said friction core; and a means mounted in said housing for adjusting said rate of descent with said descender, wherein said means for adjusting said rate of descent is comprised of a camshaft rotatably mounted in said housing, said camshaft having an axis of rotation which is perpendicular to said axis of rotation of said spool and a cam for pressing against a portion of said rope when said camshaft is rotated; and a handle mounted on an end portion of said camshaft for said rotation of said camshaft.

2. The descender apparatus recited in claim 1 further comprising a means in said descender for attaching said descender to a body restraint.

3. The descender apparatus recited in claim 2, wherein said means for attaching said descender apparatus is comprised of a tang extending downwardly from said front portion of said housing, said tang having a width and a thickness, and a pair of spaced apart bosses having apertures on said rear portion of said housing.

4. A descender apparatus for lowering a person from an elevated position to a relatively lower position, comprising: a generally cylindrical housing; a spool mounted for rotation in said housing, said spool having an axis of rotation which is perpendicular to a front face of said housing; a rope stored on said spool, said rope having a free end portion which extends upwardly from said spool; and a means for adjusting a rate of descent of said person with said descender; said means comprised of a camshaft mounted in said housing for rotation about an axis which is perpendicular to said axis of rotation of said spool, said camshaft having a cam for pressing against a portion of said rope when said camshaft is rotated; and a handle mounted on an end portion of said camshaft for said rotation of said camshaft, further comprising a friction core mounted on an upper portion of said housing, said friction core having an axis which is perpendicular to said axis of rotation of said spool and a helical groove for receiving a portion of said rope to further control said rate of decent with said descender.

5. The descender apparatus recited in claim 4 further comprising a tang extending downwardly from a lower portion of said housing, said tang having a width which is perpendicular to said axis of rotation of said spool and a thickness which is parallel to said axis of rotation of said spool; and a pair of spaced apart bosses having apertures on an upper portion of said housing; said apertures having centers which line on an axis which is parallel to said width of said tang.

6. A descender apparatus for lowering a person from an elevated position to a relatively lower position, comprising: a generally cylindrical housing; a spool mounted for rotation in said housing, said spool having an axis of rotation which is perpendicular to a path of travel of said descender apparatus; a friction core extending upwardly from said spool, said friction core having an axis which is perpendicular to said axis of rotation of said spool and a helical groove extending around an outer portion thereof; a rope stored on said spool, said rope having a free end portion which extends upwardly to engage said helical groove on said outer portion of said friction core for controlling a rate of descent with said descender; a sleeve mounted on said friction core in surrounding relationship to said helical groove of said friction core; a means for adjusting a rate of descent of said descender apparatus, said means including a camshaft rotatably mounted in said housing, said camshaft having an axis of rotation which is perpendicular to said axis of rotation of said spool, said camshaft having a cam for pressing against a portion of said rope when said camshaft is rotated and a handle for rotating said camshaft; and a means for attaching said descender, said means comprised of a tang extending downwardly from a lower portion of said housing and a pair of spaced apart bosses having apertures, on an upper portion of said housing.

* * * * *